United States Patent [19]

Moeller

[11] Patent Number: 4,520,835

[45] Date of Patent: Jun. 4, 1985

[54] PORTABLE TENT

[76] Inventor: John D. Moeller, 7854 Vernon Rd. S., Clay, N.Y. 13041

[21] Appl. No.: 497,999

[22] Filed: May 25, 1983

[51] Int. Cl.[3] ..... A45F 1/16

[52] U.S. Cl. ..... 135/102; 135/104; 135/109

[58] Field of Search ..... 135/112, 113, 104, 87, 135/95, 100, 101, 102, 103, 105, 106, 109

[56] References Cited

U.S. PATENT DOCUMENTS

| | | | |
|---|---|---|---|
| 641,946 | 1/1900 | McFarland | 135/101 X |
| 2,683,507 | 7/1954 | Coven et al. | 135/102 X |
| 3,105,505 | 10/1963 | Maybee | 135/113 X |
| 3,190,300 | 6/1965 | Wear'n | 135/104 |
| 3,368,575 | 2/1968 | Besonen | 135/109 |
| 4,343,322 | 8/1982 | Fiddler | 135/95 |

FOREIGN PATENT DOCUMENTS

| | | | |
|---|---|---|---|
| 664597 | 6/1963 | Canada | 135/112 |
| 84562 | 10/1894 | Fed. Rep. of Germany | 135/109 |
| 884109 | 1/1904 | France | 135/106 |

*Primary Examiner*—Robert A. Hafer
*Assistant Examiner*—Arnold W. Kramer
*Attorney, Agent, or Firm*—Charles S. McGuire

[57] ABSTRACT

A protective tent structure of light weight, portable construction is formed by joining a plurality of flexible support members at upper and lower terminal ends of each for pivotal movement about a linear axis through the commonly joined upper and lower ends. The tent is movable between fully erected and folded positions and, when in its folded position, the support members may be manually moved from a normal, unflexed position to a flexed position wherein the terminal ends of the support members are spaced more closely than when the members are in their unflexed positions. A separate member with hook-shaped end portions is provided for releasably retaining the support members in the flexed position while the tent is folded. In the unflexed position, the support members all include a linear base portion and an arcuate support portion, the latter being engaged with a flexible fabric covering which forms the protective portion of the tent when in the erected position.

6 Claims, 5 Drawing Figures

PORTABLE TENT

BACKGROUND OF THE INVENTION

The present invention relates to folding tent structures and, more specifically, to tent structures movable about a vertical axis between erected and folded positions and, while in the folded position, movable between flexed and unflexed positions.

The principal object of the invention is to provide a tent structure which may be moved between a folded position, wherein it is lightweight and compact enough to be easily carried by an individual, and an erected position, large enough to comfortably accommodate at least two persons, such movement being effected in seconds without assembly or engagement of parts.

A further object is to provide a tent structure which may be quickly and easily moved between erected and folded positions and, when in the folded position, rendered more compact to facilitate storage, carrying, shipping, etc., by movement to and releasable engagement in, a flexed position.

Another object is to provide a tent structure movable between folded and erected positions with a portion movable as a door between open and closed positions as a part of the folding and erecting movements of the tent.

In a more general sense, the object is to provide a conveniently portable, easily erectable, protective, folding tent structure of novel and improved design.

Other objects will in part be obvious and will in part appear hereinafter.

SUMMARY OF THE INVENTION

In accordance with the foregoing objects, the invention contemplates a tent structure having a plurality of essentially identical support members which are all attached to one another at both upper and lower terminal ends. The support members each include a linear base portion, extending from the lower terminal end to an upright portion, extending linearly at 90° to the base portion and thence curved so that the upper terminal end lies on a linear axis through the lower terminal end and perpendicular to the base portion. A flexible fabric covering is engaged with substantially the entire upright portions of all support members, for example, by stitching pockets into the covering through which the support members are inserted. The terminal ends are superposed and joined by bolts extending through loops or eyes at the ends and secured by means such as wing nuts, which may easily be manually tightened and loosened. In the folded position, all support members are essentially superposed along their entire length with the fabric covering folded or bunched around them and secured by tie strips. In the erected position the members are disposed in angularly spaced relation about the central vertical axis through the upper and lower terminal ends. One of the members may be moved angularly while the tent is erected to serve as a door, allowing the tent to be fully enclosed or partly open along one side.

The support members are formed from a material having properties and dimensions which render them sufficiently rigid to support the tent covering in a substantially rigid erected position, but are sufficiently flexible to permit relatively easy manual movement of the terminal ends to a position in closer proximity to one another when the tent is folded. This movement to a flexed position is for the purpose of reducing the height of the tent, i.e, the distance between the support member terminal ends in the unflexed position, to facilitate storage, handling, packaging, and the like. The support members are releasably maintained in the flexed position by a separate member having end portions which are hooked over the support members at the terminal ends. The members return to the original position upon release of the means which maintain them in the flexed position.

These and other features of the invention will be more fully understood by reference to the accompanying drawing and the following detailed description thereof.

DETAILED DESCRIPTION

Figure 1A:
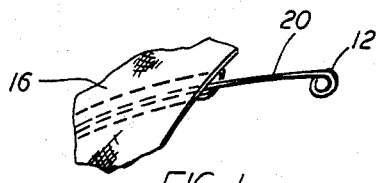
FIG. 1*a* is an enlarged, fragmentary view of a portion of the tent.
Figure 1:
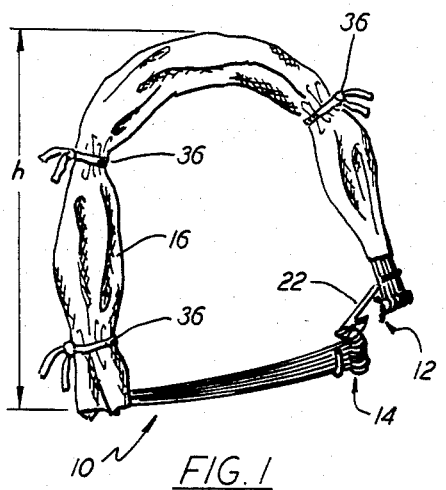
FIG. 1 is a side elevational view of the preferred embodiment of the tent of the present invention, shown in the folded and flexed positions.
Figure 2:
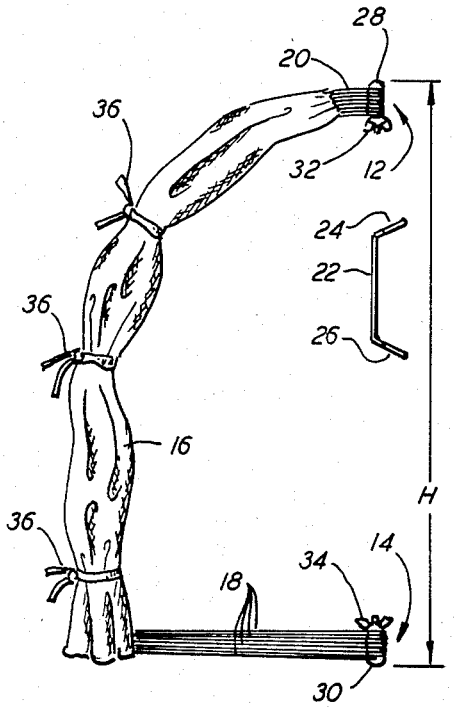
FIG. 2 is a side elevational view showing the tent in the folded, unflexed positions.

Referring now to the drawing, the tent structure comprises a plurality of substantially identical support members, collectively indicated in FIGS. 1 and 2 by reference numeral 10, having upper and lower terminal ends 12 and 14, respectively, and a flexible fabric covering 16. The tent is normally stored and transported while in a folded and flexed position, illustrated in FIG. 1. The material and dimensions of support members 10 are such that the members may be flexed from the shape in which they are originally formed, wherein terminal ends 12 and 14 are spaced by a first, predetermined distance, to a position wherein the ends are closer together. For example, a suitable material for use in tents of the size contemplated (several feet in height and diameter when erected) is 3/16 inch diameter steel rod.

Each of members 10 includes base portion 18 and upright portion 20, preferably formed from a single length of steel rod, with a permanent bend of substantially 90° in the unflexed condition, as shown in FIG. 2, at the juncture thereof. Base portions 18 extend linearly from lower terminal ends 14 to the juncture with upright portions 20, the latter being formed with a permanent curvature in at least the upper part so that upper terminal ends 12 lie on a linear axis through lower ends 14 and perpendicular to base portions 18. In this position, i.e., with the support members in their normal, unflexed condition, the overall height of the tent, whether folded or erected, is represented by dimension H.

Due to the aforementioned flexibility of support members 10, terminal ends 12 and 14 may be moved toward one another by application of manual pressure. A separate retaining member 22 is provided for releasable engagement with support members 10, at or near terminal ends 12 and 14, to maintain the tent in the flexed condition. Member 22 is formed with bent-over or hooked end portions 24 and 26 which are angularly offset in the same direction from the central portion. Thus, while holding the tent in the flexed condition, end portions 24 and 26 of retaining member 22 may be placed over the superposed support members adjacent each of the terminal ends 12 and 14 in the manner illustrated in FIG. 1. In this position, the overall height of the structure is reduced to the dimension indicated by letter h in FIG. 1 which may, for example, be on the order of one-half of dimension H, depending upon other relative dimensions of the structure.

It will be noted that the illustrated embodiment includes a total of seven support members 10. While the total number is not critical, it is necessary for purposes of the invention that not less than three such members be provided and, in order to provide the degree of stability and manner of operation which will normally be desired, the preferred number is seven. The support members are formed from initially straight lengths of material which may be permanently bent to a desired, normal configuration, which is also flexible to a degree permitting movement to a flexed position and returning to the normal configuration upon release from the flexed condition. Both upper and lower terminal ends 12 and 14 of all support members 10 are bent to a circular configuration to loosely encircle a bolt, or the like, for fastening the ends of all support members together about a common axis.

As most clearly seen from FIGS. 1 and 2, the upper and lower terminal ends are placed in superposed relation, with the openings defined thereby substantially aligned, and headed bolts 28 and 30 passed through the openings of terminal ends 12 and 14, respectively. Wing nuts 32 and 34 are threaded on bolts 28 and 30, respectively, and may be manually loosened or tightened in the usual manner. In the folded position of FIGS. 1 and 2, support members 10 are substantially superposed along their entire lengths, fabric covering 16 is folded or bunched around them and secured with tie strips 36 which may be of the same material as covering 16, attached thereto at appropriate positions by stitching, or other conventional means.

Figure 3:
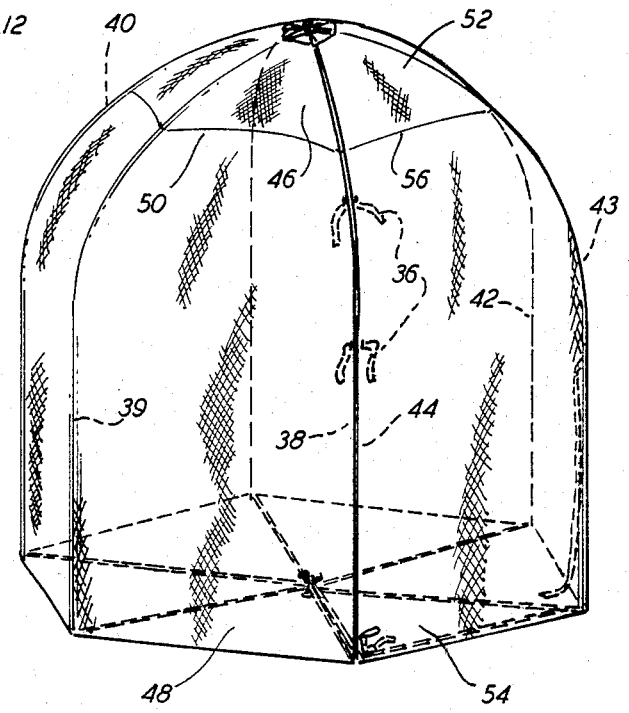
FIG. 3 is a perspective view of the tent in the fully erected position with the fabric covering extending 360° around the perimeter thereof.
Figure 4:
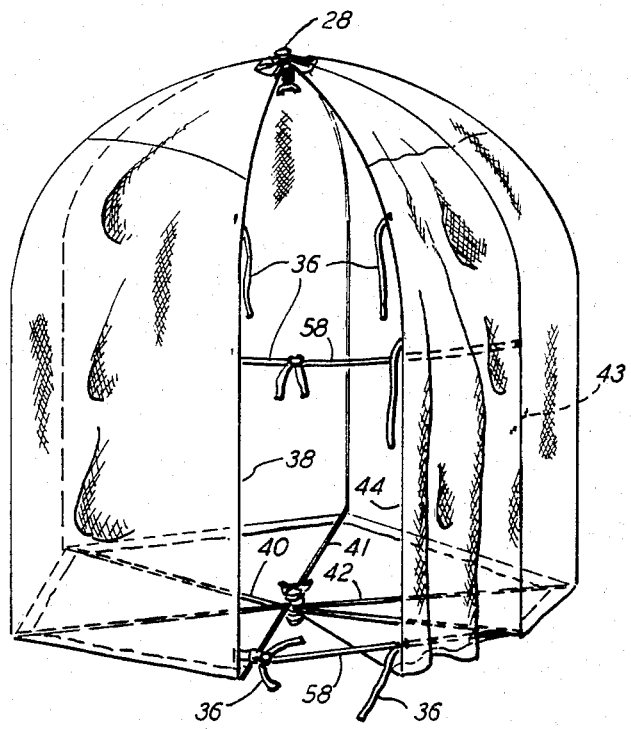
FIG. 4 is a perspective view, as in FIG. 3, showing the tent partially open along one side.

The tent structure is movable from the unflexed, folded position of FIG. 2 to the erected position of FIGS. 3 and 4, after releasing tie strips 36, simply by rotating support members 10 about the common axis through terminal ends 12 and 14 thereof. This is done, of course, with wing nuts 32 and 34 loosened sufficiently to permit free movement of the support members. Support members 10 are denoted in FIGS. 3 and 4 by separate reference numerals 38–44. Fabric covering 16 is preferably formed from a plurality of initially separate segments extending between each adjacent pair of support members, except for the first and last support members 38 and 44, where the covering terminates. Also, if desired, each of the segments may comprise two or more pieces stitched together. For example, the segment of covering between support members 38 and 39 is formed of upper and lower pieces 46 and 48, respectively, which are separately cut to the desired shape and sewn together along seam 50. Likewise, the segment between support members 43 and 44 is formed of upper and lower peices 52 and 54, joined at seam 56, etc.

Each pair of adjoining segments of covering 16 is sewn together to provide an elongated pocket, open at both ends, through which one of upright portions 20 of support members 10 passes. Similar pockets are provided along the terminating edges of the covering, through which support members 38 and 44 extend. Thus, erecting and folding movement of the tent is accomplished by grasping the upright portions of support members 38 and 44, i.e., the fabric pockets through which they extend, and rotating them about the axis through the terminal ends, which will effect rotation of the other support members by the required amount.

Each of the six segments of fabric covering 16 extends 60° about the periphery of the fully erected and enclosed tent, as seen in FIG. 3, wherein support members 38 and 44 are closely adjacent one another. Tie strips 36 are provided in adjacent pairs along the terminal edges of fabric covering 16 at support members 38 and 44 and may, if desired, be tied together within the erected tent by an occupant thereof. Also, wing nuts 32 and 34 may be tightened to hold terminal ends 12 and 14 in tight engagement, thereby enhancing stability of the tent structure.

In addition to tie strips 36, an additional pair of substantially longer strips 58 are secured at spaced locations to fabric covering 16 along the seam adjacent support member 43. Strips 58 may be tied to a correspondingly spaced pair of strips 36 secured to the terminal edge of covering 16 adjacent support member 38, as shown in FIG. 4. This provides the dual function of further increasing the stability of the structure and allowing support member 44 and the segment of covering 16 between support members 43 and 44 to be rotated in either direction, thus serving as a door movable between open and closed positions.

From the foregoing, it is apparent that the tent structure of the invention may be easily and economically fabricated in light weight, easily transportable forms. For example, while in the flexed condition the tent may easily be slung over one shoulder and across the body of an individual, to be carried virtually without effort while leaving both hands free. It may be moved to the unflexed condition simply by removing the retaining member and, after releasing the tie strips, may be moved from folded to erected position in literally about one second. The structure may be further stabilized in the erected position by tightening the wing nuts and securing the tie strips by an occupant of the tent.

While a convenient, rotationally movable door is provided by using one support member more than the number of segments in the tent covering (i.e., as illustrated, there are seven support members and six 60° covering segments) it should be noted that a tent having an equal number of support members and covering segments could be utilized. The top-to-bottom terminal edges of the covering fabric could be releasably joined by tie strips, snaps, Velcro attachments, or the like, without the use of a support member in the "door" segment. The fabric covering preferably extends from the juncture of the base and upright portions of the support members substantially to the upper terminal ends, but may terminate somewhat short therof, leaving a more or less circular opening at the top, as illustrated, if desired.

Dimensional and other considerations in the particular form of construction utilized will be dictated largely by the contemplated use of the tent structure. Although the base portions of the support members extend across the floor area, the tent structure of the invention when suitably dimensioned may be used for camping, i.e., sleeping, purposes with a modicum of padding affording adequate comfort, or by use of folding cots, etc. However, the principal contemplated uses for structures of this type are those wherein protection from the elements is desired while following outdoor, sedentary pursuits such as ice fishing, stationary bird or game hunting, bird watching, and the like.

In order to preserve the desired lightness while still providing a high degree of protection from the elements, it is preferred that the fabric covering be a material such as coated Nylon, which is essentially both wind and water proof. A tent structure suitable for occupancy by two persons in seated positions, i.e., in the principal contemplated uses mentioned above, may have dimensions of 5 feet in height and 5 feet in diagonal measurement at the base in the unflexed, erected position. The distance between the terminal ends of the support members when moved from the unflexed to the flexed positions may be reduced from 5 feet to 6 or 8 inches, which reduces the overall height to about 2½ feet (dimension h). This makes the outside dimensions something on the order of 2½ feet by 2½ feet by 2 or 3 inches, which is quite convenient for storage, carrying and especially for shipment.

What is claimed is:

1. A lightweight, portable tent structure movable between erected and folded positions, and between flexed and unflexed positions while in said folded position, said structure comprising, in combination;

(a) a plurality of not less than three substantially identical frame members, each comprising a continuous, solid, metal rod extending from a lower terminal end defining a substantially closed loop, through a linear base portion and a curved upright portion to an upper terminal end defining a substantially closed loop;

(b) said upper terminal ends of each of said frame members being superposed directly upon one another with the openings defined by said closed loops thereof aligned on a first linear axis, and said lower terminal ends being likewise superposed with the openings defined by said closed loops thereof aligned on a second linear axis, said first and second axes being vertically aligned with said first and second terminal ends spaced by a first distance, in the erected position of said tent, and angularly arranged and spaced by a second distance, less than one-quarter of said first distance, in said flexed position;

(c) means for releasably retaining said tent in said flexed position;

(d) first and second headed bolt members extending loosely through said closed loops of said first and second terminal ends, respectively, and each secured by respective nut means to maintain said first and second terminal ends in said directly superposed relation, said nut means being selectively loosened to permit free movement of said frame members about said first and second axes between said erected position, wherein said frame members are angularly disposed about said first and second axes, and said folded position, wherein said frame members are substantially mutually superposed, and tightened to frictionally engage said upper and lower, superposed terminal ends between said nut means and the heads of said bolt members to stabilize the positions of said frame members in the erected position;

(e) a flexible fabric covering extending substantially from said upper terminal ends to said base portions of said frame members and secured to said upright portions in angular segments, whereby the size of said segments establishes the angular relation of said frame members in said erected position, said covering having lateral terminal edges respectively secured to a first and a last of said frame member upright portions, and extending 360° about the periphery of said tent when in said erected position with said first and last frame members immediately adjacent one another;

(f) primary securing means for selective attachment between portions of said covering material lateral edges to maintain said first and last frame members in said adjacent position; and (g) secondary securing means for selective attachment between said first frame member and the next-to-last frame member to maintain a fixed spacing therebetween and prevent movement away from said erected position, whereby said tent may be positionally stabilized by said secondary securing means as said last frame member is moved between positions adjacent said first frame member and adjacent said next-to-last frame member.

2. The invention according to claim 1 wherein said secondary securing means comprises at least two flexible members extending between first and second, vertically spaced positions on said first and next-to-last frame members.

3. The invention according to claim 2 wherein said first position is substantially adjacent the juncture of said base and upright portions of said first and next-to-last frame members, and said second position is between about one quarter and three quarters of the height of said upright portions.

4. The invention according to claim 3 wherein said primary and secondary securing means each comprise a pair of flexible tie strips.

5. The invention according to claim 4 wherein said primary securing means comprises first and second pluralities of said tie strips fixedly attached at one end to said covering material adjacent the respective terminal edges thereof, and said secondary securing means comprises a third plurality of said tie strips fixedly attached at one end to said covering material adjacent said next-to-last frame member, said first plurality being releasably attached to said second plurality of tie strips in the secured condition of said primary securing means, and at least some of said first plurality being releasably attached to said third plurality of tie strips in the secured condition of said secondary securing means.

6. The invention according to claim 5 wherein said third plurality of tie strips are significantly longer than said first and second pluralities.

* * * * *